US007118842B2

(12) United States Patent
Qian et al.

(10) Patent No.: US 7,118,842 B2
(45) Date of Patent: Oct. 10, 2006

(54) CHARGE ADJUVANT DELIVERY SYSTEM AND METHODS

(75) Inventors: Julie Y. Qian, Woodbury, MN (US); James A. Baker, Hudson, WI (US); Gay L. Herman, Cottage Grove, MN (US)

(73) Assignee: Samsung Electronics Company, Suwon (KR)

( * ) Notice: Subject to any disclaimer, the term of this patent is extended or adjusted under 35 U.S.C. 154(b) by 105 days.

(21) Appl. No.: 10/677,094

(22) Filed: Sep. 30, 2003

(65) Prior Publication Data

US 2005/0069806 A1 Mar. 31, 2005

(51) Int. Cl.
*G03G 9/135* (2006.01)

(52) U.S. Cl. ..... 430/115; 430/117; 399/273

(58) Field of Classification Search ..... 430/112, 430/115, 117; 399/273
See application file for complete search history.

(56) References Cited

U.S. PATENT DOCUMENTS

| | | | | |
|---|---|---|---|---|
| 3,411,936 | A | 11/1968 | Roteman et al. | 117/37 |
| 3,417,019 | A | 12/1968 | Beyer | 252/62.1 |
| 3,753,760 | A * | 8/1973 | Kosel | 430/119 |
| 3,926,825 | A | 12/1975 | Honjo et al. | |
| 3,977,983 | A | 8/1976 | Tsuneda | 430/904 |
| 4,273,849 | A | 6/1981 | Merrill et al. | 430/119 |
| 4,374,918 | A * | 2/1983 | Veillette et al. | 430/115 |
| 4,547,449 | A | 10/1985 | Alexandrovich et al. | 430/115 |
| 4,707,429 | A | 11/1987 | Trout | 430/115 |
| 4,758,491 | A | 7/1988 | Alexandrovich et al. | 430/110 |
| 4,785,327 | A * | 11/1988 | Landa et al. | 399/238 |
| 4,837,103 | A * | 6/1989 | Yamamoto et al. | 430/115 |
| 4,859,559 | A | 8/1989 | Trout | 430/115 |
| 4,860,924 | A * | 8/1989 | Simms et al. | 399/57 |
| 4,886,726 | A | 12/1989 | Chan et al. | 430/115 |
| 4,935,328 | A | 6/1990 | El-Sayed et al. | 430/115 |
| 5,066,821 | A | 11/1991 | Houle et al. | 430/137 |
| 5,223,368 | A | 6/1993 | Ciccarelli et al. | 430/110 |
| 5,254,427 | A | 10/1993 | Lane et al. | 430/137 |
| 5,346,795 | A | 9/1994 | Pickering et al. | 430/110 |
| 5,366,840 | A | 11/1994 | Larson et al. | 430/115 |
| 5,411,833 | A * | 5/1995 | Swidler | 430/108.3 |
| 5,411,834 | A | 5/1995 | Fuller et al. | 430/115 |
| 5,434,030 | A | 7/1995 | Smith et al. | 430/106 |
| 5,529,875 | A | 6/1996 | Russell | 430/137 |
| 5,622,804 | A | 4/1997 | Matsuoka et al. | |
| 5,627,002 | A | 5/1997 | Pan et al. | 430/115 |
| 5,672,456 | A | 9/1997 | Chamberlain et al. | 430/115 |
| 5,679,492 | A | 10/1997 | Chamberlain et al. | 430/115 |
| 5,722,017 | A | 2/1998 | Caruthers, Jr. et al. | 399/238 |
| 6,001,524 | A | 12/1999 | Yoon et al. | 430/106 |
| 6,018,636 | A | 1/2000 | Caruthers | 399/57 |
| 2003/0044202 | A1 | 3/2003 | Song et al. | 399/238 |
| 2003/0099477 | A1 * | 5/2003 | Shimmura | 399/57 |

FOREIGN PATENT DOCUMENTS

| | | |
|---|---|---|
| EP | 0336386 A2 | 4/1989 |
| EP | 0609003 A1 | 1/1994 |
| KR | 1999-63760 | 7/1999 |
| WO | WO 90/10894 | 3/1990 |
| WO | WO 90/08983 | 8/1990 |
| WO | WO 97/12285 | 4/1997 |

OTHER PUBLICATIONS

Commonly assigned U.S. Appl. No. 10/676,371, filed Sep. 30, 2003, entitled "Adjuvants for Positively Charged Toners" (52 pgs).
Commonly assigned U.S. Appl. No. 10/676,381, filed Sep. 30, 2003, entitled "Adjuvants for Negatively Charged Toners" (48 pgs).
E.B. Caruthers, G.A. Gibson, J.R. Larson and I.D. Morrision, Xerox Corporation, Joseph C. Wilson Center for Technology, Webster, NY "Modeling of Liquid Toner Electrical Characteristics," IST&T's Tenth International Congress on Advances in Non-Impact Printing Technologies (1994), pp. 204-209.
Schmidt, S. P. and Larson, J. R. in Handbook of Imaging Materials Diamond, A. S., Ed: Marcel Dekker: New York; Chapter 6, pp. 227-252.
3 pgs, Copy of European Search Report EP 04 25 5226 filed Sep. 22, 2005.

* cited by examiner

*Primary Examiner*—John L Goodrow
(74) *Attorney, Agent, or Firm*—Kagan Binder, PLLC

(57) ABSTRACT

A system for printing a liquid toner is provided comprising a liquid electrographic toner composition comprising a liquid carrier having a Kauri-Butanol number less than about 30 mL and a plurality of charged toner particles dispersed in the liquid carrier, wherein the toner particles comprise a polymeric binder. The system also comprises a charge control adjuvant having limited solubility in the liquid carrier. The charge control adjuvant preferably is present in the liquid carrier in an amount in excess of the solubility of the adjuvant in the liquid carrier. Alternatively, the charge control adjuvant may be dispersed in a matrix having limited solubility in the liquid carrier or encapsulated within a matrix to form microcapsules having limited solubility in the liquid carrier. The charge control adjuvant in any of the above forms may be provided in a number of formats for release into the toner composition as needed.

The charge control adjuvant is released into the toner composition as needed to provide charge control relative to the bulk conductivity of the toner composition and/or the charge per unit mass of the toner particles.

29 Claims, 3 Drawing Sheets

CHARGE ADJUVANT DELIVERY SYSTEM AND METHODS

FIELD OF THE INVENTION

The invention relates to toner systems. More specifically, the invention relates to systems for delivery of liquid toners comprising charge control adjuvants.

BACKGROUND

In electrophotographic and electrostatic printing processes (collectively electrographic processes), an electrostatic image is formed on the surface of a photoreceptive element or dielectric element, respectively, with a toner. In electrostatic printing, a latent image is typically formed by (1) placing a charge image onto a dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. In electrophotographic printing, also referred to as xerography, electrophotographic technology is used to produce images on a final image receptor, such as paper, film, or the like. Electrophotographic technology is incorporated into a wide range of equipment including photocopiers, laser printers, facsimile machines, and the like.

Electrophotography typically involves the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning and erasure.

In the charging step, a photoreceptor is covered with charge of a desired polarity, either negative or positive, typically with a corona or charging roller. In the exposure step, an optical system, typically a laser scanner or diode array, forms a latent image by selectively discharging the charged surface of the photoreceptor in an imagewise manner corresponding to the desired image to be formed on the final image receptor. In the development step, toner particles of the appropriate polarity are generally brought into contact with the latent image on the photoreceptor, typically using a developer electrically-biased to a potential opposite in polarity to the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed.

Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like.

U.S. Pat. No. 4,547,449 to Alexandrovich, et al. discloses liquid electrographic developers comprising an electrically insulating liquid carrier, toner, a charge-control agent and a charging agent. The charge-control agent is a carrier-soluble, addition copolymer of a quaternary ammonium salt monomer, a monomer having —COOH, —$SO_3H$ or —$PO_3HR$ acidic function wherein R is hydrogen or alkyl, and a solubilizing monomer. The charging agent is a carrier-soluble, addition polar copolymer. The disclosed developers are stated to exhibit improved replenishability as evidenced by reduced buildup of charge in the developers during the course of use and repeated replenishment. Specifically, this patent noted that the prior art exhibited drawbacks relating to the stability of their charge as they are used through a number of copy sequences. In particular, the charge of the developer per unit of mass of dispersed toner of the prior art increases, indicating that the quaternary ammonium charge-control copolymer deposits on an electrostatic image at a lower rate than the toner. This uneven depletion rate and consequential increase in charge per unit mass in the developer presents difficulty in developer replenishment and causes nonuniform image density from copy to copy. The invention as described therein is asserted to stabilize the charge of the developer per unit mass of toner is so that, after a period of use, the buildup of charge per unit of mass is significantly reduced. Such stability is stated to be achieved when the quaternary ammonium salt charge-control polymer in the developer composition contains an insolubilizing monomer having an acidic function selected from the group consisting of —COOH, —$SO_3H$ or —$PO_3HR$ acidic function wherein R is hydrogen or alkyl.

U.S. Pat. No. 6,018,636 to Caruthers discloses an imaging system wherein changes in toner developability of toners in a liquid toner system are determined and compensated for by sensing the toner concentration and liquid toner volume in a tank, based on changes in the toner concentration and toner mass in the tank. Based on measurements made of the toner and/or a test printed image, adjustments can be made, such as creating a new voltage differential or adding toner and/or liquid carrier material to the tank.

U.S. Pat. No. 5,722,017 to Caruthers discloses a liquid developing material replenishment system wherein an apparatus for developing an electrostatic latent image with a liquid developing material includes a liquid developing element for providing a supply of operative liquid developing material to the developing apparatus, and a liquid developing material supply is coupled to the liquid developing material element for providing a supply of liquid developing concentrate to the liquid developing material element for replenishing the supply of operative liquid developing material in the liquid developing element. A developed image having a large proportion of printed image area or having substantially a single color will cause a greater depletion of marking particles and/or charge director in the liquid developing material supply tank as compared to a developed image with a small amount of printed image area or of a single color. This patent explains that > while the rate of the replenishment of the liquid developing material may be controlled by simply monitoring the level of liquid developer in the supply element 116, in advanced systems the rate of replenishment of the liquid carrier, the marking particles, and/or the charge director components of the liquid developing material is controlled in a more sophisticated manner to maintain a predetermined concentration of the marking particles and the charge director in the operative solution stored in the supply element 116. One exemplary replenishment systems of this nature include systems which measure the conductivity of the operative liquid developing material and add selective amounts of charge director compound to the element as a function of the measured a conductivity, as disclosed in detail in U.S. Pat. No. 4,860,924, incorporated by reference herein. Another system of this nature is disclosed in commonly assigned U.S. patent application Ser. No. 08/551,381, also incorporated by reference herein, which describes control of the amount of carrier liquid, charge director and/or marking particles in a liquid developing material element in response to the amount of each component depleted therefrom as a function of the number of pixels making up each developed image.

See column 14, line 48 to column 15, line 3.

U.S. Pat. No. 4,860,924 to Simms, et. al. discloses a copier wherein charge director is supplied to a liquid developer in response to a conductivity measurement thereof. Toner concentrate deficient in charge director is supplied to the liquid developer in response to an optical transmissivity measurement thereof. Conductivity is measured by a pair of spaced electrodes immersed in the developer and through which a variable alternating current is passed. A variable capacitor neutralizes the inherent capacitance of the electrodes. A phase sensitive detector is provided with a reference voltage having the same phase shift as that caused by capacitive effects. The conductivity measurement is corrected in response to a developer temperature measurement.

SUMMARY OF THE INVENTION

The conductivity of a conventional liquid toner usually increases with the number of prints, and thus decreases optical density of the images. Usually after 2000 to 3000 prints, the toner conductivities will become too high to produce a good image. New systems for delivery of a liquid toner to a printer are provided that are capable of adding a charge control adjuvant in proper amounts without using mechanical or electronic sensing apparatuses or complex control systems. The system comprises a liquid electrographic toner composition comprising a liquid carrier having a Kauri-Butanol number less than about 30 mL and a plurality of charged toner particles dispersed in the liquid carrier, wherein the toner particles comprise a polymeric binder. The system also comprises a charge control adjuvant having limited solubility in the liquid carrier. The charge control adjuvant preferably is present in the liquid carrier in an amount in excess of the solubility of the adjuvant in the liquid carrier. Alternatively, the charge control adjuvant may be dispersed in a matrix having limited solubility in the liquid carrier, the matrix preferably being present in the liquid carrier in an amount in excess of the solubility of the matrix in the liquid carrier. In yet another alternative, the charge control adjuvant may be encapsulated within a matrix to form microcapsules having limited solubility in the liquid carrier, the microcapsules preferably being present in the liquid carrier in an amount in excess of the solubility of the matrix in the liquid carrier.

The charge control adjuvant in any of the above forms may be provided in a number of formats for release into the toner composition as needed. For example, the charge control adjuvant may be provided as a non-solvated element affixed to a wall of the toner supply container, for example as a block or other bulk component. As another example, the charge control adjuvant is provided as a film coated on at least one wall of the toner supply container. Alternatively, the charge control adjuvant is provided as particles dispersed in the liquid carrier of the toner composition. In another configuration, the system comprises a conveying roll for conveying the toner to the photoreceptive element or dielectric element, and the charge control adjuvant is provided as a coating on the conveying roll.

For purposes of the present invention, a charge control adjuvant is any material that modulates the bulk conductivity of the toner composition and/or the charge per mass of the toner particles in the toner composition.

DETAILED DESCRIPTION

The system of the present invention uses solubility and concentration factors to deliver charge control adjuvant to a toner composition as needed to provide proper charge balance. Surprisingly, systems of the present invention may be provided that favorably modulate both bulk conductivity and charge per mass, resulting in excellent image generation.

Figure 1:
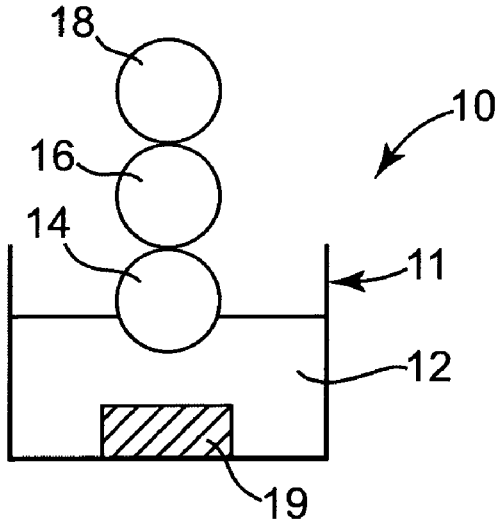
FIG. 1 is an end view in partial cross-section of a system of the present invention having the non-solvated portion of charge control adjuvant provided as a element.

Turning now to the drawings, FIG. 1 shows an end view in partial cross-section of an embodiment of a system 10 having a liquid toner composition 12 disposed in toner supply container 11. Toner is conveyed to a light sensitive temporary image receptor (organic photoreceptor or "OPC") 18 by conveyer rolls 14 and 16. Alternative conveying apparatuses may be used as will be apparent to the skilled artisan, such as pumping the toner composition through supply lines, and the like. Charge control adjuvant element 19 is provided in the toner composition to provide charge control adjuvant in an amount in excess of the solubility of the adjuvant in the liquid carrier. Charge control adjuvant element 19 is shown in a block configuration, available for additional solvation by the liquid carrier as concentration conditions allow due to withdrawal of toner particles (not shown) from the toner composition. Charge control adjuvant may be provided in a single component form, or may be provided in combination with a matrix material for ease of affixing the charge control adjuvant or for modulating the release of charge control adjuvant into the toner composition. Charge control adjuvant element 19 comprises non-solubilized charge control adjuvant, and may be in the form, for example of a solid, semisolid or gel. Charge control adjuvant element 19 may merely be placed in toner supply container 10, or may be affixed to a wall or other structure of toner supply container 10.

As noted above, a charge control adjuvant of the present invention is any material that modulates the bulk conductivity of the toner composition and/or the charge per mass of the toner particles in the toner composition. Preferably, the charge control adjuvant is selected to decrease the bulk conductivity of the toner composition and/or the charge per mass of the toner particles in the toner composition, and more preferably decreases both the bulk conductivity of the toner composition and the charge per mass of the toner particles in the toner composition. Preferred charge control adjuvants are acids or bases.

The charge control adjuvant may be a monomeric, oligomeric, or polymeric material, provided that it comprises sufficient acid or base functionality to exhibit the desired charge control attributes as described herein. Preferably, the charge control adjuvant is present in the liquid carrier in an amount higher than the solubility of the charge control adjuvant in the liquid carrier, or in other words, there is insolubilized charge control adjuvant present in the system. Preferably, the charge control agent has a solubility of from about 0.1 to about 10 mg/g in the liquid carrier. Surprisingly, the charge control adjuvant need have very little solubility in the liquid carrier to provide excellent charge control properties as described herein. In particular, polymeric charge control adjuvants that are sparingly soluble are surprisingly effective in providing the desired charge control properties. Thus, it has surprisingly been found that a polymeric article as described herein may be placed in contact with the liquid carrier of the toner composition at some point in the printing process, with the result of charge control benefits being observed. In one aspect of the present invention, a structure that a toner composition contacts may be formed from a polymeric charge control adjuvant, with the result of charge control benefits being observed.

When the charge control adjuvant is a base, it is preferably selected from amines. The amine functionalities may be primary, secondary or tertiary amines. In one embodiment of the present invention, the charge control adjuvant may be an amine functional polymer, such as a silicone polymer having amine functionalities (e.g. aminoalkyl pendant functionalities), or may be a carbon based polymer having amine functionalities (e.g. acrylate, polyester, epoxy or polyether polymer comprising amine functionalities). An example of such a polymer is GP530, commercially available from Genesee Polymers, Flint, Mich. In another embodiment of the present invention, the charge control adjuvant may be a hydroxyl functional polymer, such as Joncryl™ polymers designated with the numbers SCX-804 or 578 from S. C. Johnson Polymers, Racine, Wis.

In a preferred embodiment of the present invention, the charge control adjuvant is selected from the group consisting of alkyl amines, and most preferably alkyl amines having 6 to 60 carbon atoms in the alkyl portions of the alkyl group of the alkyl amine. In a particularly preferred embodiment, the charge control adjuvant is one or more alkyl amines having 12 to 18 carbon atoms in the alkyl portions of the alkyl group of the alkyl amine. Examples of specifically preferred charge control adjuvants include hexylamine, octylamine, dodecylamine, tetradecylamine, hexadecylamine, octadecylamine and mixtures thereof.

When the charge control adjuvant is an acid, it is preferably selected from carboxylic and sulfonic acids. In one embodiment of the present invention, the charge control adjuvant may be an acid functional polymer, such as a silicone polymer having acid functionalities or may be a carbon based polymer having acid functionalities (e.g. acrylate, polyester, epoxy or polyether polymer comprising acid functionalities). Examples of such polymers include styrene acrylic resins having carboxyl functionality, such as "ALMACRYL B-1504" from Image Polymers Co., Wilmington, Mass., and Joncryl™ polymers designated with the numbers 67, 586, 611, 678, 690, SCX-815, SCX-817, SCX-819, SCX-835 and SCX-839 from S. C. Johnson Polymers, Racine, Wis. Further examples include ethylene vinyl acetate acid terpolymers such as ELVAX polymer designated 4260, 4310, 4320 and 4355.

In a preferred embodiment of the present invention, the charge control adjuvant is selected from the group consisting of alkyl acids, and most preferably alkyl acids having 6 to 60 carbon atoms in the alkyl portions of the alkyl group of the alkyl acid. In a particularly preferred embodiment, the charge control adjuvant is one or more alkyl acids having 12 to 18 carbon atoms in the alkyl portions of the alkyl group of the alkyl acid. Preferably the acid is an alkyl benzene sulfonic acid or an alkyl carboxylic acid. Examples of specifically preferred charge control adjuvants include hexanoic acid, octanoic acid, dodecanoic acid, tetradecanoic acid, hexadecanoic acid, octadecanoic acid, hexyl benzene sulfonic acid, octyl benzene sulfonic acid, dodecyl benzene sulfonic acid, tetradecyl benzene sulfonic acid, hexadecyl benzene sulfonic acid, octadecyl benzene sulfonic acid and mixtures thereof. In a preferred embodiment, the charge control adjuvant is ABSA, an alkyl benzene sulfonic acid that comprises a blend of C11, C12 and C13 carbon chain length alkyl portions.

In a particularly preferred embodiment, the charge control adjuvant is capable of forming micelles in the liquid carrier. Most preferably, the charge control adjuvant is the present in the composition in the form of micelles having a size range of from about 5 to about 50 nm.

The charge control adjuvant is preferably selected to have minimal solubility in the toner composition, so that the charge control adjuvant is solvated from the charge control adjuvant element 19 on a controlled and "as needed" basis. Charge control adjuvant element 19 may optionally be formulated by providing charge control adjuvant dispersed in a matrix, thereby modifying the overall delivery and release characteristics of charge control adjuvant element 19. Preferably, the matrix is selected from the group consisting of hydrocarbon waxes, silicon waxes and natural waxes. Various ratios of components may be readily determined to provide the desired release characteristics of charge control adjuvant from charge control adjuvant element 19. Additionally, alternative configurations of charge control adjuvant element 19 to increase or decrease available surface area of charge control adjuvant element 19 to facilitate appropriates release profiles of charge control adjuvant from charge control adjuvant element 19 may be utilized.

Figure 2:
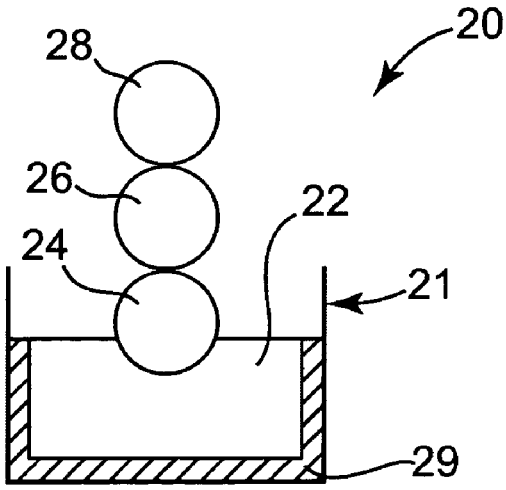
FIG. 2 is an end view in partial cross-section of a system of the present invention having the non-solvated portion of charge control adjuvant provided as a coating.

FIG. 2 shows an alternative embodiment of a system 20 having a liquid toner composition 22 disposed in toner supply container 21. Toner is conveyed to OPC 28 by conveyer rolls 24 and 26. Charge control adjuvant coating 29 is provided on some or all of the interior surfaces of the toner supply container 20. Thus, charge control adjuvant is provided in the toner composition in an amount in excess of the solubility of the adjuvant in the liquid carrier. In a manner as above, alternative configurations of charge control adjuvant coating 29 to increase or decrease available surface area of charge control adjuvant coating 29 to facilitate appropriates release profiles of charge control adjuvant from charge control adjuvant coating 29 may be utilized. For example, the coating may be provided as a highly porous layer or as a layer having a varied surface topography to increase available surface area of charge control adjuvant coating 29.

Figure 3:
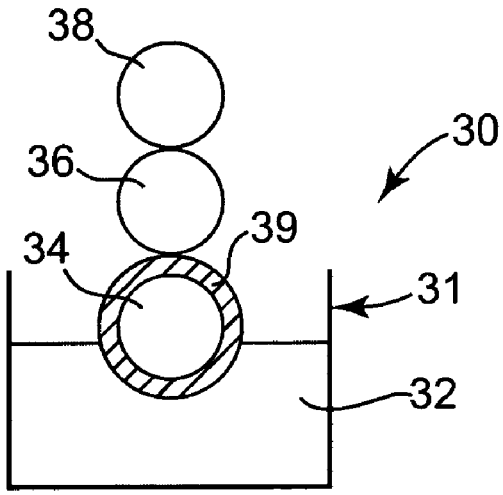
FIG. 3 is an end view in partial cross-section of a system of the present invention having the non-solvated portion of charge control adjuvant provided as a coating on a conveying roll.

FIG. 3 shows an alternative embodiment of system 30 having a liquid toner composition 32 disposed in toner supply container 31. Toner is conveyed to OPC 38 by conveyer rolls 34 and 36. Charge control adjuvant coating 39 is provided on conveyer roll 34. Various alternative locations for non-solvated charge control adjuvant will now be appreciated. Solid form charge control adjuvant may be located at any desired location on or in the toner supply container where the charge control adjuvant will contact the liquid toner and be available for being delivered to the liquid toner composition as needed to provide charge balance.

Figure 4:
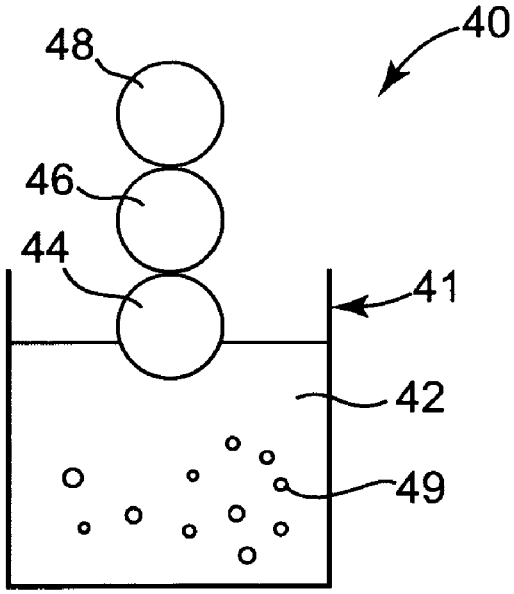
FIG. 4 is an end view in partial cross-section of a system of the present invention having the non-solvated portion of charge control adjuvant provided as a microcapsules or particles dispersed in the toner composition.

FIG. 4 shows yet another embodiment of system 40 having a liquid toner composition 42 disposed in toner supply container 41. Toner is conveyed OPC 48 by conveyer rolls 44 and 46. Charge control adjuvant microcapsules or particles 49 are dispersed in the toner composition 42. Alternatively, microcapsules and/or matrix particles may be incorporated into a separate coating or otherwise contained, such as by a porous retaining screen or other physical barrier (not shown) that prevents withdrawal of microcapsules or matrix particles from the toner composition together with the toner particles during printing operations, but allows contact of the microcapsules or matrix particles with the liquid toner composition to facilitate delivery of the charge control adjuvant to the composition.

Figure 5:
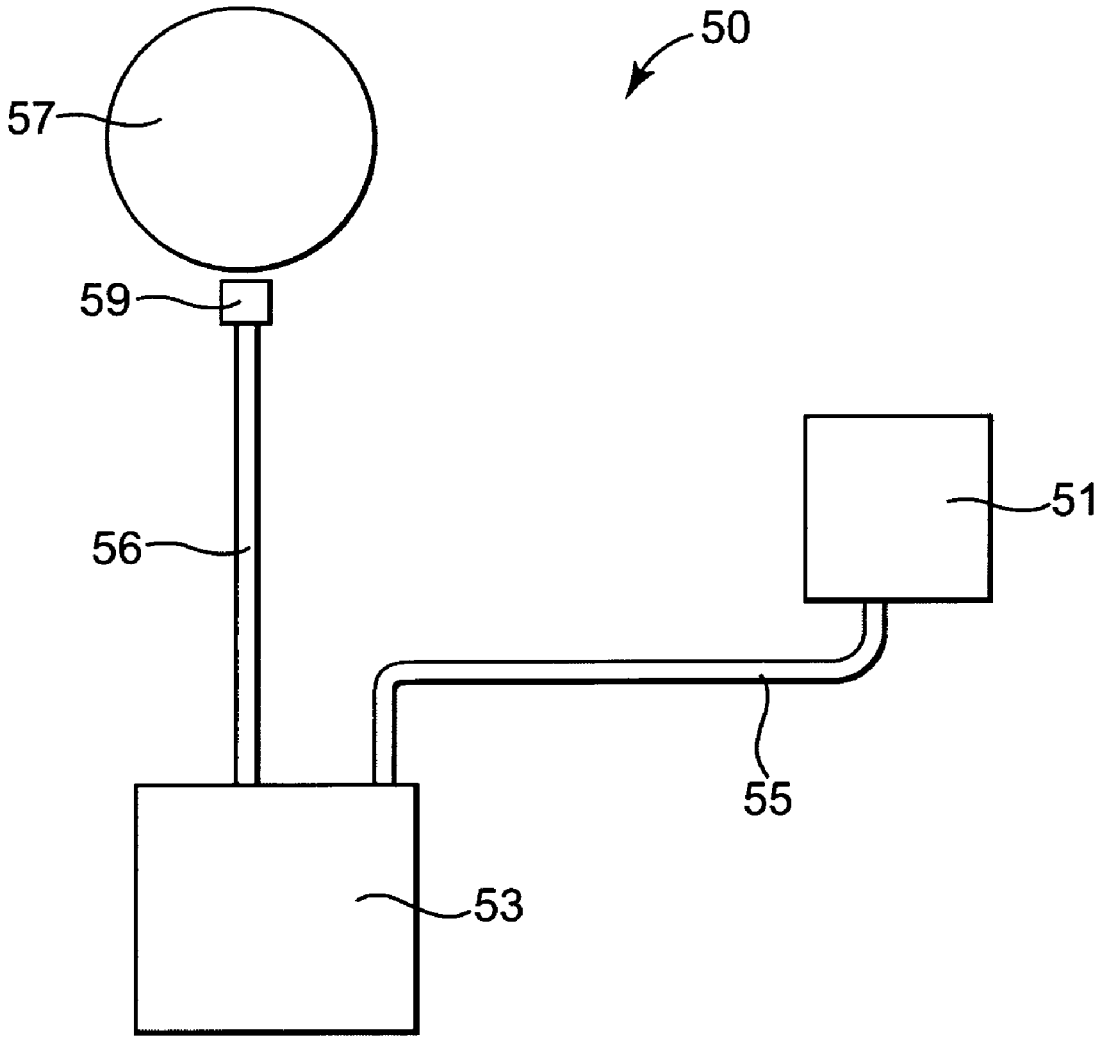
FIG. 5 is a schematic diagram of a system of the present invention comprising a developing material supply between a toner container and a toner applicator.

FIG. 5 shows a schematic diagram of system 50, comprising toner container 51 connected to developing material supply 53 by supply line 55. Liquid toner composition is provided in toner container 51 and fed to developing material supply 53 through supply line 55 in a conventional manner, so that additional liquid toner may be introduced to system 50 preferably without interruption of an ongoing printing operation. The thus supplied liquid toner composition is applied to OPC 57 by toner applicator 59 through supply line 56. Charge control adjuvant may be provided in any of the above formats at any convenient location in system 50. Thus, for example, an element comprising charge control adjuvant, either neat or in a matrix, may be located in toner container 51, developing material supply 53, or either supply line 55 or 56. Optionally, the charge control adjuvant may be provided in a separately engageable receptacle that may be fitted at any attachment point of supply line 55 or 56, or intermediate to supply line 55 or 56.

Various suitable toner resins may be used in the toner composition used in the present invention. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Preferably, the toner comprises charged toner particles dispersed in the liquid carrier, wherein the toner particles comprise a polymeric binder comprising at least one amphipathic graft copolymer comprising one or more S material portions and one or more D material portions. As used herein, the term "amphipathic" refers to a copolymer having a combination of portions having distinct solubility and dispersibility characteristics in a desired liquid carrier that is used to make the copolymer and/or used in the course of preparing the liquid toner particles. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier. Details of the mechanism of formation of sterically stabilized amphipathic copolymers are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975. See also U.S. Pat. Nos. 5,886,067; 6,103,781 and 6,255,363.

Once the amphipathic graft copolymer has been formed, one or more additives can be incorporated, as desired. For example, one or more visual enhancement additives and/or charge control agents can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 5 microns) and may also partially shred the dispersed copolymeric binder into fragments that can associate with the surface of the visual enhancement additive.

According to this embodiment, the dispersed copolymer or fragments derived from the copolymer then associate with the visual enhancement additive, for example, by adsorbing to or adhering to the surface of the visual enhancement additive, thereby forming toner particles. The result is a sterically-stabilized, nonaqueous dispersion of toner particles having a volume mean particle diameter (determined with laser diffraction) in the range of about 0.05 to about 50.0 microns, more preferably in the range of about 3 to about 10 microns, most preferably in the range of about 1.5 to about 5 microns. In some embodiments, one or more charge directors can be added before or after mixing, if desired.

Several characteristics of liquid toner compositions are important to provide high quality images. Toner particle size and charge characteristics are especially important to form high quality images with good resolution. Further, rapid self-fixing of the toner particles is an important requirement for some liquid electrophotographic printing applications, e.g. to avoid printing defects (such as smearing or trailing-edge tailing) and incomplete transfer in high-speed printing. For example, in organosol toner compositions that exhibit low Tgs, the resulting film that is formed during the imaging process may be sticky and cohesively weak under transfer conditions. This may result in image splitting or undesired residue left on the photoreceptor or intermediate image receptor surfaces. Another important consideration in formulating a liquid toner composition relates to the durability and archivability of the image on the final receptor. Erasure resistance, e.g. resistance to removal or damage of the toned image by abrasion, particularly by abrasion from natural or synthetic rubber erasers commonly used to remove extraneous pencil or pen markings, is a desirable characteristic of liquid toner particles.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer when used as the binder of the toner particle. Alternatively, the polymerization may be carried out in any appropriate solvent, and a solvent exchange may be carried out to provide the desired liquid carrier for the toner composition.

As noted above, the toner particles are positively or negatively charged. This charge is preferably provided by addition of one or more charge directors (also known as a charge control additive or "CCA"). The charge director can be included as a separate ingredient and/or included as one or more functional moiety(ies) of the binder polymer. The charge director acts to enhance the chargeability and/or impart a charge to the toner particles.

The charge director can be incorporated into the toner particles using a variety of methods, such as copolymerizing a suitable monomer with the other monomers used to form the copolymer, chemically reacting the charge director with the toner particle, chemically or physically adsorbing the charge control agent onto the toner particle (resin or pigment), or chelating the charge control agent to a functional group incorporated into the toner particle.

The charge director acts to impart an electrical charge of selected polarity onto the toner particles. Any number of charge directors described in the art can be used. For example, the charge director can be provided it the form of metal salts consisting of polyvalent metal ions and organic anions as the counterion. Suitable metal ions include, but are not limited to, Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred negative charge directors include those described in the art, such as lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt. e.g., Na, of a phosphoglyceride, e.g. Emphos™ D70-30C, Witco Chemical Corp., New York. N.Y., which is a sodium salt of phosphated mono- and diglycerides. Particularly preferred negative charge directors include lecithin and basic barium petronate.

Preferred positive charge directors include metal salts consisting of polyvalent metal ions and organic anions as the counterion. Suitable metal ions include, but are not limited to, Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, lauric acid, tallic acid, and the like.

Preferred positive charge directors include metallic soaps, and particularly metallic carboxylates, for example, as described in U.S. Pat. No. 3,411,936 (incorporated herein by reference). Preferably, the metal of the metal soap is selected from zirconium, tin and titanium. A particularly preferred positive charge director is zirconium tetraoctoate (available as Zirconium HEX-CEM from OMG Chemical Company, Cleveland, Ohio).

The preferred charge director levels for a given toner formulation will depend upon a number of factors, including the composition of the polymeric binder, the pigment used in making the toner composition, and the ratio of binder to pigment. In addition, preferred charge director levels will depend upon the nature of the electrophotographic imaging process. The level of charge director can be adjusted based upon the parameters listed herein, as known in the art. The amount of the charge director, based on 100 parts by weight of the toner solids, is generally in the range of 0.01 to 10 parts by weight, preferably 0.1 to 5 parts by weight.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 3 to about 10 microns, most preferably in the range of about 1.5 to about 5 microns.

A particularly preferred embodiment of the present invention is provided when the toner particle comprises an amphipathic graft copolymer that is positively charged, and the charge control adjuvant is an acid or base as described in commonly assigned U.S. patent application Ser. No. 10/676,371 entitled "ADJUVANTS FOR POSITIVELY CHARGED TONERS," filed on even date herewith, published as U.S. patent application Ser. No. 2005/0069804 A1, and incorporated by reference herein.

A particularly preferred embodiment of the present invention is provided when the toner particle comprises an amphipathic graft copolymer that is negatively charged, and the charge control adjuvant is an acid or base as described in commonly assigned U.S. patent application Ser. No. 10/676,381 entitled "ADJUVANTS FOR NEGATIVELY CHARGED TONERS," filed on even date herewith, published as U.S. patent application Ser. No. 2005/0069805 A1, and incorporated by reference herein.

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

The invention claimed is:

1. A system for printing a liquid toner, comprising a) a liquid electrographic toner composition comprising:
   i) a liquid carrier having a Kauri-Butanol number less than about 30 mL,
   ii) a plurality of charged toner particles dispersed in the liquid carrier, wherein the toner particles comprise a polymeric binder; and b) a charge control adjuvant having limited solubility in the liquid carrier provided as an element separate from the charged toner particles, in contact with the liquid carrier and in an amount higher than the solubility of the charge control adjuvant in the liquid carrier.

2. The system of claim 1, wherein the liquid toner composition is disposed within a toner supply container.

3. The system of claim 2, wherein the charge control adjuvant is provided as a non-solvated element in the toner supply container.

4. The system of claim 2, wherein the charge control adjuvant is provided as a non-solvated element affixed to a wall of the toner supply container.

5. The system of claim 2, wherein the charge control adjuvant is provided as a film coated on at least one wall of the toner supply container.

6. The system of claim 1, wherein the charge control adjuvant is provided as particles dispersed in the liquid carrier of the toner composition.

7. The system of claim 1, wherein the system comprises a conveying roll for conveying the toner composition to a photoreceptive element or a dielectric element, and the charge control adjuvant is provided as a coating on the conveying roll.

8. The system of claim 1, wherein the charge control adjuvant is provided at a location between a toner supply container and a toner applicator so that the liquid toner composition contacts the charge control adjuvant prior to application of the toner to a substrate.

9. The system of claim 8, wherein the charge control adjuvant is provided at a toner composition feed line between a toner supply container and the toner applicator.

10. The system of claim 8, wherein the charge control adjuvant is provided at a toner developer reservoir between a toner supply container and the toner applicator.

11. A system for printing a liquid toner, comprising a) a liquid electrographic toner composition comprising:

i) a liquid carrier having a Kauri-Butanol number less than about 30 mL, ii) a plurality of charged toner particles dispersed in the liquid carrier, wherein the toner particles comprise a polymeric binder; and b) a charge control adjuvant dispersed in a matrix provided as an element separate from the charged toner particles, wherein the matrix has limited solubility in the liquid carrier and the charge control adjuvant dispersed in the matrix is provided in an amount higher than the solubility of the matrix in the liquid carrier.

12. The system of claim 11, wherein the charge control adjuvant is present in the liquid carrier in an amount in excess of the solubility of the matrix in the liquid carrier.

13. The system of claim 11, wherein the liquid toner composition is disposed within a toner supply container.

14. The system of claim 13, wherein the matrix is provided as a non-solvated element in the toner supply container.

15. The system of claim 13, wherein the matrix is provided as a non-solvated element affixed to a wall of the toner supply container.

16. The system of claim 13, wherein the matrix is provided as a film coated on at least one wall of the toner supply container.

17. The system of claim 12, wherein the matrix is provided as particles dispersed in the liquid carrier of the toner composition.

18. The system of claim 12, wherein the system comprises a conveying roll for conveying the toner composition to a photoreceptive element or a dielectric element, and the matrix is provided as a coating on the conveying roll.

19. The system of claim 12, wherein the matrix is provided at a location between a toner supply container and a toner applicator so that the liquid toner composition contacts the matrix prior to application of the toner to a substrate.

20. The system of claim 19, wherein the matrix is provided at a toner composition feed line between a toner supply container and the toner applicator.

21. The system of claim 19, wherein the matrix is provided at a toner developer reservoir between a toner supply container and the toner applicator.

22. The toner supply container of claim 11, wherein the matrix is selected from the group consisting of hydrocarbon waxes, silicon waxes and natural waxes.

23. A system for printing a liquid toner, comprising a) a liquid electrographic toner composition comprising:

i) a liquid carrier having a Kauri-Butanol number less than about 30 mL, ii) a plurality of charged toner particles dispersed in the liquid carrier, wherein the toner particles comprise a polymeric binder; and b) a charge control adjuvant encapsulated within a matrix to form microcapsules provided as an element separate from the charged toner particles, wherein the matrix has limited solubility in the liquid carrier and the charge control adjuvant encapsulated in the matrix is provided in an amount higher than the solubility of the matrix in the liquid carrier.

24. The system of claim 23, wherein the microcapsules are present in the liquid carrier in an amount in excess of the solubility of the matrix in the liquid carrier.

25. The system of claim 23, wherein charge control adjuvant is soluble in the liquid carrier.

26. The system of claim 23, wherein the matrix is selected from the group consisting of hydrocarbon waxes, silicon waxes and natural waxes.

27. A method of printing an image, comprising a) providing a system of claim 1, and b) withdrawing the charged toner particles in an amount to print at least one image thereby changing the charge and composition of the toner composition, wherein the charge of the toner composition is modulated by contact of the charge control adjuvant with the liquid composition.

28. A method of printing an image, comprising a) providing a system of claim 11, and b) withdrawing the charged toner particles in an amount to print at least one image thereby changing the charge and composition of the toner composition, herein the charge of the toner composition is modulated by contact of the matrix with the liquid toner composition.

29. A method of printing an image, comprising a) providing a system of claim 23, and b) withdrawing the charged toner particles in an amount to print at least one image thereby changing the charge and composition of the toner composition, wherein the charge of the toner composition is modulated by contact of the microcapsules with the liquid toner composition.

* * * * *